US005452989A

United States Patent [19]

Rood et al.

[11] Patent Number: 5,452,989

[45] Date of Patent: Sep. 26, 1995

[54] REVERSE PHASE AND HIGH DISCHARGE TEMPERATURE PROTECTION IN A SCROLL COMPRESSOR

[75] Inventors: Jerry A. Rood; Peter A. Kotlarek, both of Onalaska, Wis.

[73] Assignee: American Standard Inc., Piscataway, N.J.

[21] Appl. No.: 227,927

[22] Filed: Apr. 15, 1994

[51] Int. Cl.[6] ..... F04B 49/00

[52] U.S. Cl. ..... 417/29; 417/32; 417/53; 417/280; 417/291; 417/310

[58] Field of Search ..... 417/29, 32, 53, 417/280, 291, 310

[56] References Cited

U.S. PATENT DOCUMENTS

| | | | |
|---|---|---|---|
| 4,560,330 | 12/1985 | Murayama et al. | 418/55 |
| 4,820,130 | 4/1989 | Eber et al. | 417/32 |
| 4,840,545 | 6/1989 | Moilanen | 417/301 |
| 4,998,864 | 3/1991 | Muir | 417/410 |
| 5,118,260 | 6/1992 | Fraser, Jr. | 417/18 |
| 5,141,407 | 8/1992 | Ramsey et al. | 417/292 |
| 5,167,491 | 12/1992 | Keller, Jr. et al. | 417/32 |
| 5,169,294 | 12/1992 | Barito | 417/310 |
| 5,186,613 | 2/1993 | Kotlarek et al. | 417/291 |
| 5,248,244 | 9/1993 | Ho et al. | 417/292 |
| 5,290,154 | 3/1994 | Kotlarek et al. | 417/272 |

FOREIGN PATENT DOCUMENTS

| | | | |
|---|---|---|---|
| 404303193 | 10/1992 | Japan | 417/32 |
| 405052196 | 3/1993 | Japan | 417/32 |

*Primary Examiner*—Richard A. Bertsch
*Assistant Examiner*—Yuan M. Thai
*Attorney, Agent, or Firm*—William J. Beres; William O'Driscoll; Peter D. Ferguson

[57] ABSTRACT

Protective apparatus in a scroll compressor, in the form of a valve assembly, is operative to prevent compressor damage from reverse direction rotation of the scroll compression mechanism or the development of abnormally high discharge gas temperatures. The valve assembly is disposed in a passage communicating between the suction and discharge pressure portions of the compressor shell and houses a discharge temperature sensor immediately adjacent the location from which discharge gas issues from the compression mechanism. The location of the sensor and its exposure to discharge gas permits the timely sensing of abnormally high discharge temperatures and the shutdown of the compressor upon their occurrence. The valve assembly includes a vent valve which lifts, upon the reverse direction orbital motion of the orbiting scroll member and creation of a pressure less than suction pressure in the discharge pressure portion of the compressor, so as to provide an internal flow path and volume within the compressor against which the compression mechanism can pump where it would otherwise be damaged in pumping against a closed volume.

26 Claims, 3 Drawing Sheets

FIG. 5
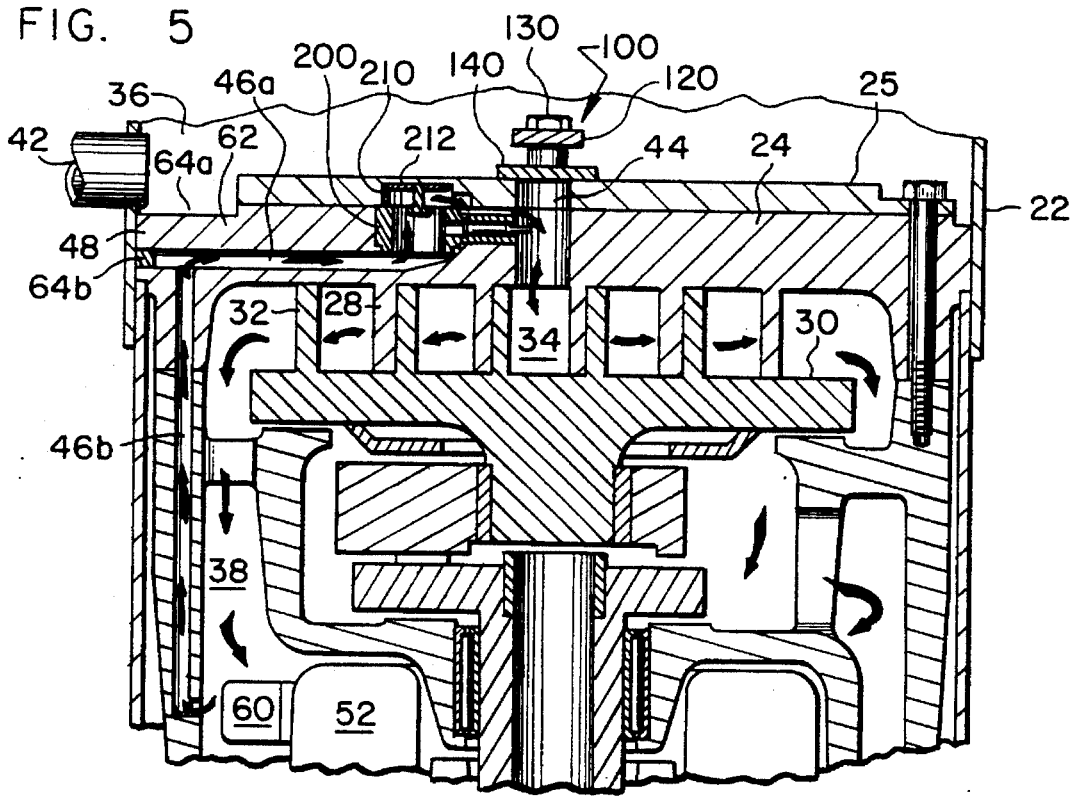
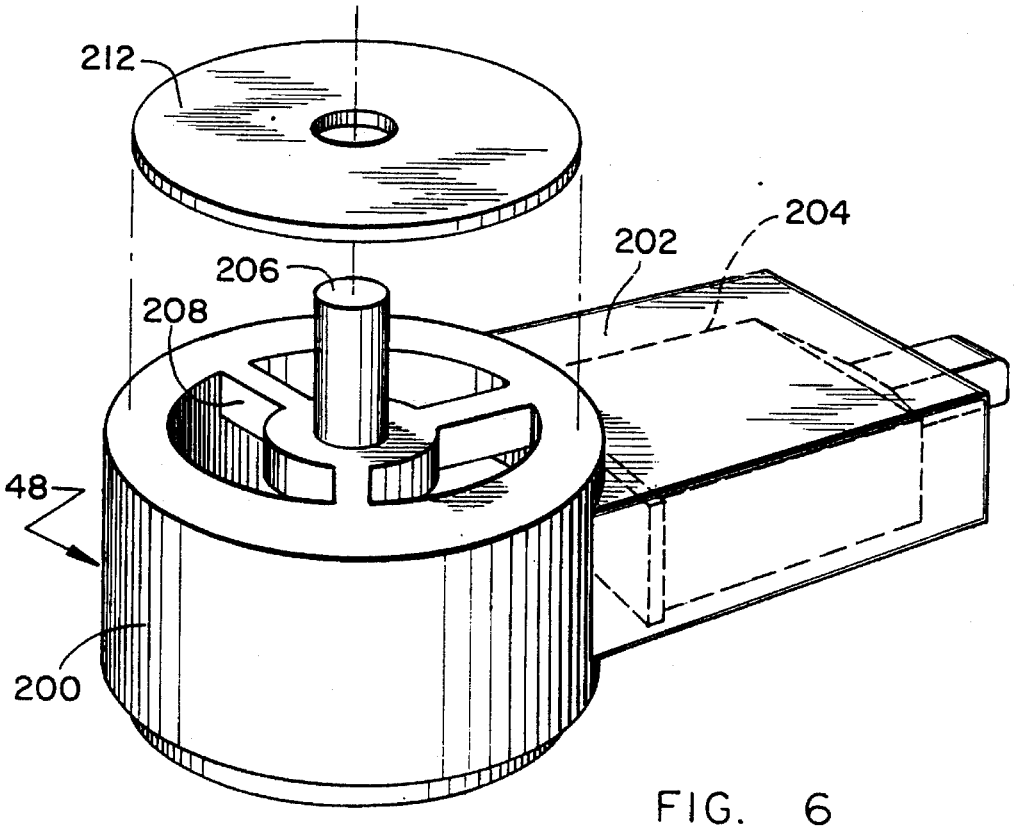
FIG. 6

REVERSE PHASE AND HIGH DISCHARGE TEMPERATURE PROTECTION IN A SCROLL COMPRESSOR

TECHNICAL FIELD

This invention relates generally to the protection of scroll compressors against the damage which can occur from the existence of certain abnormal compressor operating conditions. More specifically, this invention relates to protective apparatus within a scroll compressor for the prevention of damage to the interleaved scroll members due to the misdirection rotation of the compressor or the effects of abnormally high discharge gas temperatures.

BACKGROUND OF THE INVENTION

A common problem in hermetic rotary compressors, including those of the scroll type, is the tendency of compressed refrigerant gas to flow back from the discharge pressure portion or so-called high side of the compressor shell, through the compression mechanism and back to the suction pressure portion or so-called low side of the shell upon compressor shutdown. Such backflow is as a result of the natural tendency of the system within which the compressor is employed to equalize its internal pressure when the compressor is de-energized and the fact that scroll compressors, unlike reciprocating compressors, do not rely on the use of a discharge valve against which to pump in order to effect gas compression. Discharge gas backflow, if not prevented, can cause the reverse direction rotation of the scroll members (which comprise the compression mechanism) at speeds far higher than that at which the compressor is intended to operate and can lead to serious compressor damage, such as due to inadequate bearing lubrication, under such circumstances.

The prevention of discharge gas backflow upon shutdown in a scroll compressor is typically accomplished by the disposition of a discharge check valve downstream of the aperture through which compressed gas is discharged from the compressor's compression mechanism. The discharge check valve is carried shut by the initial backflow of refrigerant gas which occurs immediately upon compressor shutdown. The closing of the discharge check valve may be assisted or accelerated by a biasing member such as a spring.

In scroll compressors having compression mechanisms protected from discharge gas-driven reverse rotation by apparatus such as a discharge check valve, a problem can arise when the compressor is electrically connected in an improper manner. Such improper electrical connection, like discharge gas backflow, can cause the compressor motor and, therefore, the compression mechanism, to operate in a direction reverse from that in which they are intended to rotate. This problem is recognized in U.S. Pat. Nos. 4,820,130; 4,840,545; 5,186,613 and 5,290,154 all of which are assigned to the assignee of the present invention.

Briefly, if a scroll compressor having a discharge check valve is miswired so that it is caused to rotate in an unintended direction, the pockets defined between the scroll wraps, instead of moving radially inward and decreasing in volume, move radially outward and expand in volume in a pumping action. In effect, the scroll device functions as a gas expander rather than a compressor under such circumstances.

The expansion of the pockets defined by the scroll members under these circumstances, unless otherwise accommodated for, can cause low and even negative pressures to develop within the pockets defined by the scroll members because the discharge check valve, being closed, gives the mechanism no source of gas to pump from in its motor-driven reverse direction rotation. As a result, the scroll members can be drawn tightly together which will eventually result, to the extent the compressor continues to be motor-driven in the wrong direction, in severe damage to and possibly destruction of the compressor.

Still another difficulty and potential source for damage in scroll compressors is the development of high discharge gas temperatures. Such high discharge temperatures can be caused, among other things, by the operation of the compressor in a system where pressure ratios develop that are outside of the compressor's normal operating range and can result in thermal growth within the compressor, particularly in the wraps of the scroll members. Thermal expansion of the scroll wraps can lead to high wrap tip contact loads and the galling of the wrap tips.

The need continues to exist to efficiently and effectively protect hermetic scroll compressors from the damage which can result from their improper electrical hookup and from the occurrence of high discharge gas temperatures.

SUMMARY OF THE INVENTION

With the above in mind, it is an object of the present invention to prevent the damage which can result from the improper electrical hookup of a scroll compressor and the reverse direction rotation of the scroll members which results therefrom.

It is another object of the present invention to provide protection for a scroll compressor against the damage which can result from the development of high compressor discharge gas temperatures.

It is a further object of the present invention to provide protection for a scroll compressor against the damage which can result from the reverse direction operation of the compressor's motor and orbiting scroll member and from the development of high discharge temperatures through the action of a combined compressor protective assembly.

These and other objects of the present invention, which will be appreciated when the attached Drawing Figures and the Description of the Preferred Embodiment found hereinbelow are considered, are addressed and achieved in a scroll compressor having a protective valve assembly which is disposed and forms a pressure boundary in a passage defined between the suction pressure portion and discharge pressure portions of the compressor. The valve assembly is configured to house and support a discharge temperature sensor in a location immediately proximate the location from which discharge gas exits from the compression mechanism when the compressor is in operation so that the sensor is exposed to discharge gas where it is at its hottest.

The discharge temperature sensor is therefore positioned to provide immediate response to the development of abnormally high discharge gas temperatures by its communication of an electrical signal which causes the shutdown the compressor motor in advance of a damage to the compressor. The sensor leads are conveniently routed through a portion of the passage defined between the suction and discharge pressure portions of the compressor which is in uninterruptable communication with the suction pressure portion or low side of the compressor's shell. This advantageously obviates the need to define a dedicated passage for discharge temperature sensor leads out of the discharge portion of the compressor shell.

The protective valve assembly also includes a reverse vent valve which is maintained seated (in a closed position) by the discharge pressure which exists in the passage on the discharge pressure side of the valve assembly when the compressor is in normal operation. Under the circumstance of abnormal compressor or system operating conditions such as those resulting in the development of a lower pressure in what would normally be the discharge pressure portion of the compressor's shell than exists in the suction pressure portion of the shell, the reverse vent valve is caused to lift by the differential pressure thereacross. The lifting of the vent valve provides an internal, short-circuited flow path between the suction and discharge pressure portions of the compressor and a region from which the compression mechanism, acting as an expander during its misdirection rotation, can pump without damage.

BRIEF DESCRIPTION OF THE DRAWINGS

FIG. 5 is a reproduction of FIG. 2 illustrating the operation of the protective arrangement of the present invention and the gas flow through the compressor when it is miswired so as to run in the reverse direction or when sub-suction pressures are otherwise caused to develop in the discharge pocket defined by the scroll members.

FIG. 6 is an exploded perspective view of the protective valve assembly of the present invention.

DESCRIPTION OF THE PREFERRED EMBODIMENT

Figure 1:
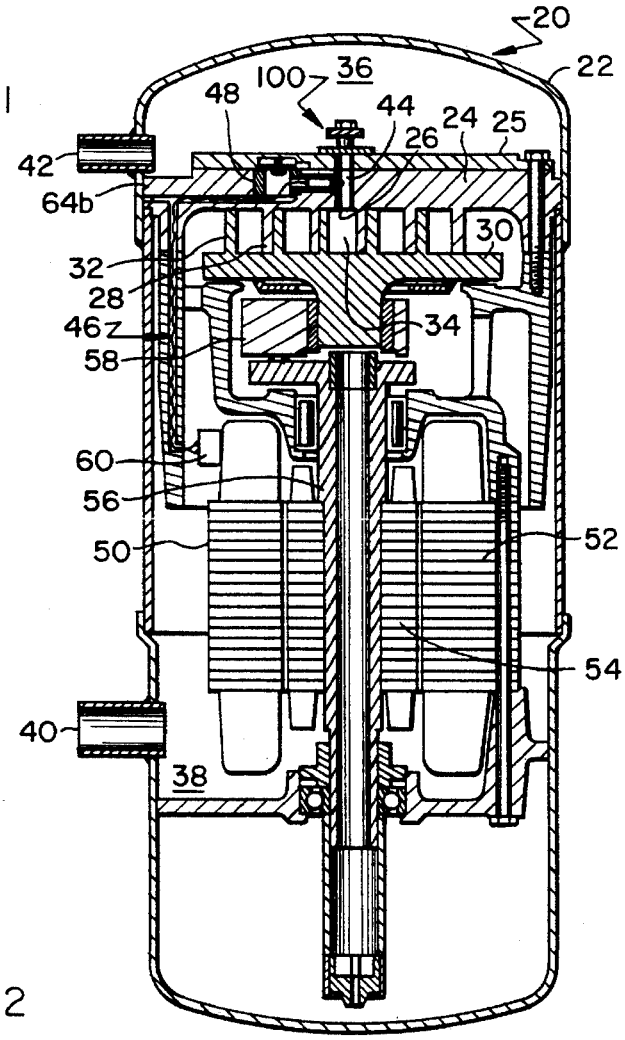
FIG. 1 shows a cross-sectional view of a low-side scroll compressor which embodies the present invention.

Referring first to FIGS. 1 through 4, compressor 20 has a hermetic shell 22, in which a fixed scroll member 24 is disposed. Fixed scroll member 24 is overlain by a valve cover 25, defines a discharge aperture 26 and has an involute wrap 28 extending from it. An orbiting scroll member 30 is disposed in shell 22 and likewise has an extending involute wrap 32 which is disposed in interleaving engagement with the involute wrap 28 of fixed scroll member 24. Together, interleaved fixed and orbiting scroll members 24 and 30 comprise the compression mechanism of compressor 20. The operating principles of scroll compressors are well known and will therefore not be discussed in great detail other than as necessary to describe the present invention.

Scroll members 24 and 30 and their interleaved involute wraps 28 and 32 cooperate to define a plurality of pockets therebetween. The volume of the pockets decrease as they move in a radially inward direction toward discharge aperture 26 when compressor 20 is in normal operation. The pockets and their movement are created by the relative orbital motion of the scroll members. Discharge pocket 34 is the radially innermost pocket defined by the scroll members and is in flow communication with discharge aperture 26 of the fixed scroll member.

In the preferred embodiment, fixed scroll member 24 serves to divide hermetic shell 22 into a discharge pressure portion 36 and a suction pressure portion 38. It should be understood that the division of hermetic shell 22 into a discharge pressure portion 36 and suction pressure portion 38 can, however, be accomplished by means other than the use of fixed scroll member 24 such as by the use of an independent frame, barrier or seal member.

A suction fitting 40 is provided to permit gas at suction pressure to enter suction pressure portion 38 of hermetic shell 22. As is illustrated by the arrows in FIG. 4, suction gas enters the radially outer suction pockets defined by the scroll members. These pockets are cyclically formed, closed and move radially inward, decreasing in volume during their inward movement, by the orbital movement of the orbiting scroll member with respect to the fixed scroll member. A discharge fitting 42 is provided in shell 22 to permit the discharge of compressed gas from the discharge pressure portion 36 of the compressor shell.

Communicating between discharge aperture 26 and the discharge portion of shell 22, through fixed scroll member 24 and valve cover 25, is a discharge passage 44 through which compressed gas is communicated from discharge pocket 34 into the discharge pressure portion of the compressor when the compressor is in normal operation. An internal passage 46, in which protective valve assembly 48 is disposed and which is comprised of passage portions **46*a* and 46*b*, communicates between discharge passage 44 and suction pressure portion 38 of the compressor shell. Valve assembly 48** functions to protect the compressor against damage due to the development of high discharge gas temperatures and against the development of pressures in the discharge pressure portion of the compressor which are less than those found in the suction pressure portion thereof.

During normal compressor operation, passage portion **46*a* will be at discharge pressure since it is in uninterruptable flow communication with discharge passage 44. Passage portion 46*b* will be at suction pressure when the compressor is in normal operation since it is in uninterruptable flow communication with the suction pressure portion 38 of the compressor. Flow through passage 46 under normal compressor operating conditions is prevented by valve assembly 48** and the positioning of its components under normal operating conditions as will further be described.

Compressor 20 is driven by an electric motor 50 which is disposed in suction pressure portion 38 of shell 22 and is therefore a low side compressor. Motor 50 includes a stator 52 and rotor 54. A drive shaft 56 may connect motor rotor 54 and orbiting scroll member 28 through a swing link mechanism 58. Motor 50 may include a thermally actuated line break device 60 associated with stator 52.

Although compressor 20 is illustrated as including a swing link mechanism, it should be understood that the present invention is equally applicable to scroll compressors which do not make use of swing link apparatus, including scroll compressors of the fixed throw type. It must also be understood that although device 60 is illustrated as being a line break device disposed in the suction pressure portion of the compressor shell, it is merely representative of devices which are capable of interrupting power to a motor including contactors **60*a* which are exterior of shell 22 and are schematically illustrated in phantom in FIG. 4**.

Compressor 20 includes means, operable when the pressure in discharge pressure portion 36 of shell 22 exceeds the pressure in discharge pocket 34, such as upon compressor shutdown, for preventing the backflow of refrigerant gas from discharge pressure portion of the shell back through passage 44 and into discharge pocket 34. As is illustrated, such means may be a discharge check valve assembly 100 which overlies fixed scroll member 24 within the discharge pressure portion 36 of shell 22. Alternatively, a discharge check valve may be located outside of the shell 22 of compressor 20 such as in discharge fitting 42 of FIG. 4, where a discharge check valve 100' is schematically illustrated in phantom, or in system piping downstream of discharge fitting 42.

Discharge check valve assembly 100, many variations and types of which are available, may be comprised of a stop member 120 which is fixedly disposed between guide posts 130. Valve assembly 100 includes a free-floating valve element 140 which operates between a closed position in which it seats over and closes passage 44 and an open position in which the flow of discharge gas through passage 44 lifts valve element 140 upward so that it seats against stop member 120.

Figure 2:
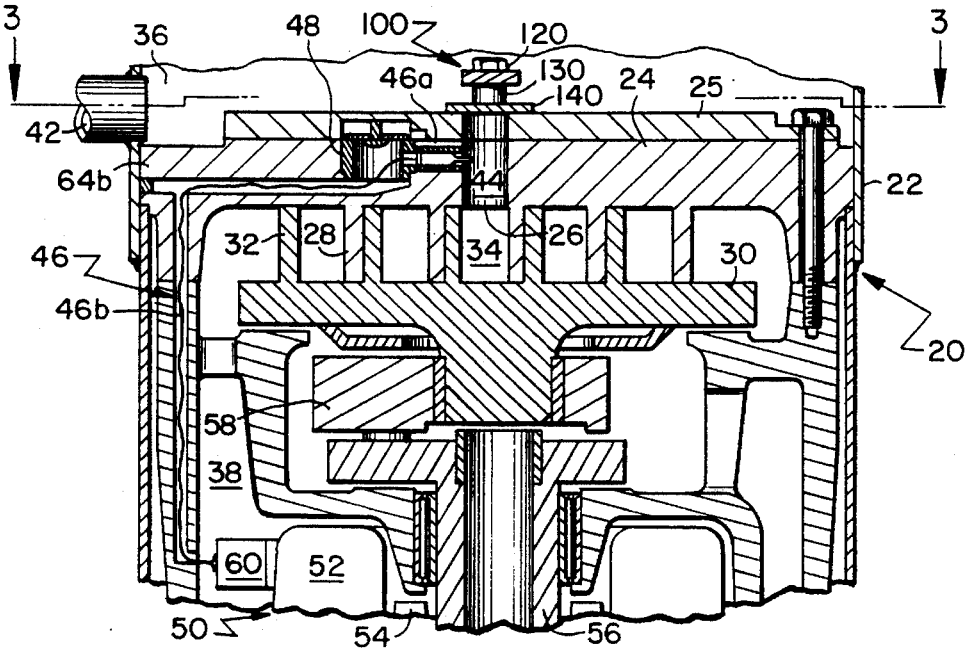
FIG. 2 is an enlarged partial cross-sectional view of the upper portion of the compressor illustrated in FIG. 1 with the compressor in its de-energized state.
Figure 3:
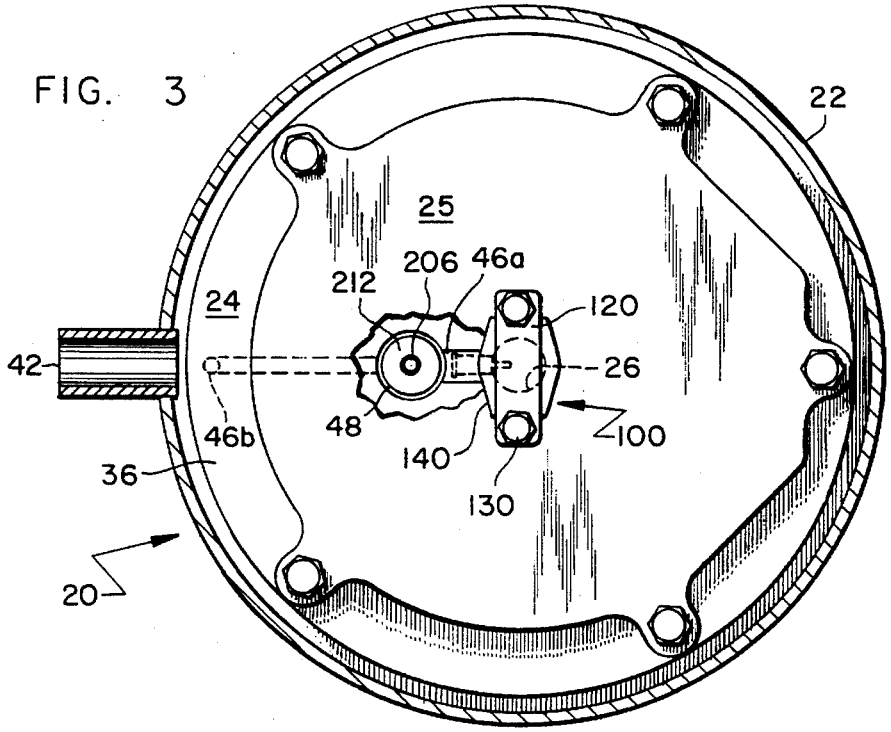
FIG. 3 is a view taken along line 3—3 of FIG. 2.
Figure 4:
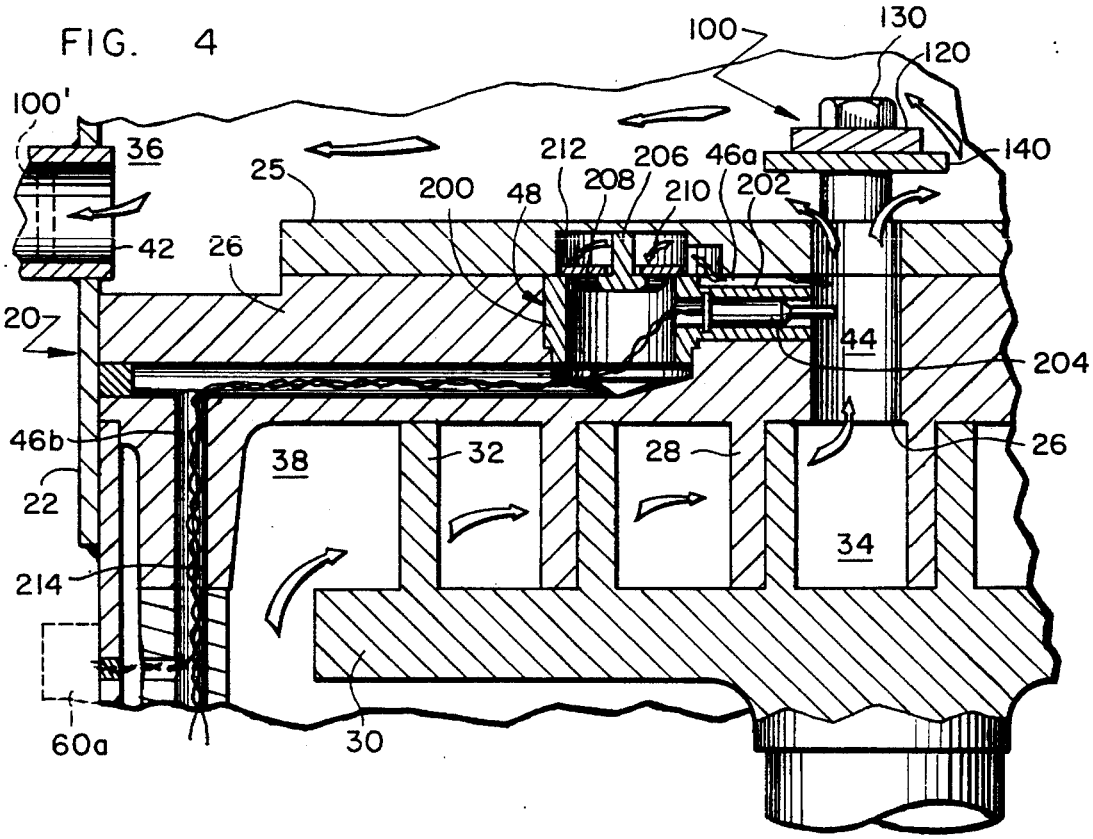
FIG. 4 is a further enlarged reproduction of a portion of FIG. 2 showing the disposition of the compressor discharge valve and gas flow path through the scroll member of the present invention when the compressor is in normal operation.

When compressor 20 is shut down and pressures within shell 22 are equalized, valve element 140 rests over discharge passage 44, as is illustrated in FIG. 2, and is maintained there by force of gravity or, optionally, by a biasing member (not shown) such as a spring. When compressor 22 starts and discharge gas begins to flow through passage 44 from pocket 34, the flow of the compressed gas lifts valve element 140 and maintains it in the open position resting against stop member 120 as is illustrated in FIG. 4.

Upon compressor shutdown, when orbiting scroll member 30 ceases to be driven by motor 50 and the scroll members cease to interact to compress gas between them, discharge pressure gas will immediately begin to flow back out of the discharge pressure portion 36 of shell 22, toward and into passage 44. In doing so, the backflowing gas will immediately carry valve element 140 downward so as to close off passage 44 from the discharge portion 36 of shell 22 which prevents the continuance of such backflow. The elevated pressure in discharge portion 36, so long as it exists, will assist in maintaining valve element 140 seated. The pressure across the valve element and within the compressor will eventually equalize as pressures equalize across the system in which the compressor is employed.

The near immediate closure of the discharge valve cuts off discharge gas backflow to the compression mechanism within the compressor from the system in which the compressor is employed. It will be appreciated that the system in which the compressor is employed will contain a relatively much larger volume of discharge pressure gas at such time as the compressor shuts down than will be found in the limited volume of the discharge portion of the compressor shell. If orbiting scroll member 28 were permitted to be driven in the reverse direction by such backflow at high speed and for too long a period of time under the influence of a large downstream volume of discharge pressure gas, as the case would be absent the use of a discharge check valve, damage to the compressor would result as has been discussed above. The discharge valve will, in any event, close on compressor shut down and will remain closed until the compressor next operates to compress and discharge gas.

Because valve element 140 will be in its closed position whenever the compressor is at rest, including those instances where the compressor has not yet been initially wired to a power source or has been electrically disconnected, it will be appreciated that if motor 50 is initially or subsequently miswired such that orbiting scroll member 28 is driven in a direction opposite from that which is intended, the pockets defined by the scroll member, including discharge pocket 34 will be caused to expand and move radially outward as is illustrated by the arrows in FIG. 5. Compressor 20 will function, in effect, as an expander and will pump against the closed discharge check valve.

When compressor 20 operates as an expander, the pressure in the compression pockets, including discharge pocket 34, is pulled down and can become less than suction pressure unless other accommodations are provided for. This is due to the fact that closed valve element 140 prevents the flow of gas from the discharge pressure portion of the compressor or from downstream thereof which eliminates a source of gas from which the miswired apparatus can pump. Under such conditions, the tips of the wraps of the scroll members are drawn into high frictional contact with the opposing scroll member and severe compressor damage can occur.

Referring particularly now to FIGS. 4 and 6, the nature and operation of protective valve assembly 48, which addresses the abnormal compressor operating conditions discussed above, will be described. Valve assembly 48 includes a vent body 200 which is ensconced in an accommodating portion of fixed scroll member 26. It is to be noted that although valve assembly 48 is illustrated as being disposed in the fixed scroll member, in other embodiments/compressor designs, a frame or similar structure, other than one which functions as the fixed scroll member, might be employed to separate the discharge pressure and suction pressure portions of the compressor shell. In that case, valve assembly 48 could be disposed in such other separating structure.

Vent body 200 includes an extension 202 in which temperature sensor 204 is disposed. Guide post 206 of vent body 200 extends upward from an open grid 208 into a recess 210 defined by valve plate 25 which overlies valve assembly 48 in the compressor. Recess 210 is, in effect, a portion of passage portion **46*a* and provides for flow communication between passage portions 46*a* and 46*b* when free-floating vent valve 212, which is penetrated by guide post 206**, lifts as will further be described.

Upon the occurrence of high discharge gas temperatures, sensor 204 electrically signals for compressor motor 50 to be de-energized. Temperature sensor 204 is electrically connected via leads 214 to external motor contactors **60*a* (shown in phantom in FIG. 4) or to internal line break device 60 or to any other device which, upon the receipt of an appropriate electrical signal will operate to de-energize motor 50**.

Since it comprises a pressure boundary between the discharge pressure portion and suction pressure portions of the compressor, sensor 204 is sealingly disposed within extension 202 of vent body 200 so as to prevent the leakage of discharge pressure gas therearound. Leads 214 are conveniently and advantageously routed from sensor 204 through passage portion **46*b*, which will always be at suction pressure, and thence to the external motor contactors 60*a* or line break device 60** or another similar device as the case may be.

It will be appreciated that it is preferable to route leads 214 from sensor 204 through and out of the low side of the compressor shell, such as to contactors **60*a*** if necessary, rather than through the discharge pressure portion of the compressor as has been the case in many low side compressors of previous designs where discharge gas temperature sensors are directly exposed to and/or located in the discharge pressure portion of the compressor. This is because the breach of the compressor shell by the penetration of such leads represents a potential failure or leakage path with respect to the integrity of the compressor shell. In that regard, penetration of the shell in a low pressure location is clearly preferred.

Extension 202 of vent body 200 projects into a position proximate discharge passage 44 so that sensor 202 is located to best sense the temperature of compressor discharge gas at a point immediate the location of its issuance from discharge pocket 34 where it is at its hottest. Sensor 202 is therefore positioned to provide immediate response, by the communication of an electrical signal such as to motor contactors 60*a* external of the compressor shell or internal line break device 60 as the case may be, to the development of abnormally high discharge gas temperatures.

Referring now to FIG. 5, operation of the protective apparatus of the present invention to prevent compressor damage due to the development of sub-suction pressures in what is normally the discharge pressure portion of the Compressor shell, such as might occur upon the reverse direction operation of the orbiting scroll member, will be described. As has previously been indicated, in the event that motor 50 of compressor 20 is miswired so that it runs backward, compressor 20 will function as an expander. The expansion of the compression pockets, including discharge pocket 34, causes a reduction in pressure in those pockets such that pressures less than suction pressure come to exist almost immediately within the pockets defined between the scroll members.

Since discharge pocket 34 is open to discharge passage 44 which, under such circumstances, is isolated from the discharge pressure portion of the compressor by the seating of the discharge check valve, the development of a sub-suction pressure within discharge pocket 34 will result in the development of sub-suction pressures both in discharge passage 44 and in passage portion 46*a*. The development of sub-suction pressure in passage portion 46*a* causes a pressure gradient to occur across valve assembly 48 since the portion 46*b* of passage 46, which is located on the opposite side of valve assembly 48, is uninterruptably open to the suction pressure portion of the compressor.

The existence of a pressure in passage portion 46*a* less than the pressure which is found in passage portion 46*b* causes vent valve 212 of valve assembly 48 to lift into recess 210. When vent valve 212 is lifted and opens passage 46 while the compression mechanism is operating in a reverse direction, the scroll members are provided a source of gas from which to pump and do so with effectively no differential pressure thereacross since the opening of passage 46 under this circumstance effectively places the suction pressure portion of the shell both upstream and downstream of the compression mechanism. Therefore the damaging clamping of the scroll members together under the circumstance of misdirection scroll member rotation is avoided.

At such time as pressure greater than suction pressure comes to exist in discharge pocket 34, discharge passage 44 and passage portion 46*a*, such as by the proper wiring and rotation of the compressor motor and the resulting compression of gas between the scroll members, valve member 212 seats which, in turn, prevents the further flow of gas through passage 46 under what amounts to normal compressor operating conditions. Valve assembly 48 is therefore instrumental in effectively and efficiently protecting compressor 20 against two abnormal and potentially catastrophic conditions which might otherwise come to exist internal of the compressor shell.

As will be appreciated, other alternatives and equivalents are suggested by and fall within the scope of the invention described hereinabove. Therefore, the present invention is not to be limited other than in accordance with the language of the claims which follow.

What is claimed is:

1. Scroll gas compression apparatus comprising:

a shell, said shell defining a suction pressure portion, a discharge pressure portion and a passage therebetween;

a first scroll member disposed in said shell, said first scroll member having an involute wrap and defining a discharge aperture, said aperture being in uninterruptable flow communication with said passage;

a second scroll member disposed in said shell, said second scroll member having an involute wrap in interleaving engagement with the involute wrap of said first scroll member, the wraps of said first and said second scroll members cooperating to define a discharge pocket, said discharge pocket being in flow communication with said discharge aperture of said first scroll member;

a motor for driving one of said scroll members;

means for de-energizing said motor; and means, disposed in said passage, for preventing damage to said compressor, said means for preventing damage (i) opening said passage for flow when the pressure in said discharge pocket is less than the pressure in said suction pressure portion of said shell and (ii) sensing the development of a temperature higher than a predetermined temperature in gas discharged from said discharge pocket and electrically signaling the sensing of such higher temperature to said means for de-energizing said motor.

2. The scroll gas compression apparatus according to claim 1 wherein said means for preventing damage to said compressor comprises a valve assembly, said valve assembly dividing said passage into a first portion and a second portion, said first portion of said passage being in uninterruptable flow communication with said discharge aperture said second portion of said passage being in uninterruptable flow communication with said suction pressure portion of said shell.

3. The scroll gas compression apparatus according to claim 2 wherein said valve assembly includes a vent valve, said vent valve being pressure biased to close said passage when the pressure in said first portion of said passage is greater than the pressure in said second portion of said passage.

4. The scroll gas compression apparatus according to claim 3 wherein said valve assembly includes a valve body and a temperature sensor, said temperature sensor being housed by said valve body and positioned thereby so as to be exposed to compressor discharge gas in a location proximate its issuance from said discharge aperture.

5. The scroll gas compression apparatus according to claim 4 wherein said temperature sensor includes an electrical lead, said lead running from said temperature sensor into said second passage portion.

6. The scroll gas compression apparatus according to claim 5 wherein said means for de-energizing said motor comprises electrical contactors exterior of said shell, said lead penetrating said shell in its suction pressure portion and being electrically connected to said contactors.

7. The scroll gas compression apparatus according to claim 5 further comprising a valve cover, said valve cover cooperating in the definition of said first portion of said passage and overlying said valve assembly.

8. The scroll gas compression apparatus according to claim 5 wherein said vent valve is a free floating valve.

9. The scroll gas compression apparatus according to claim 5 wherein said means for de-energizing said motor comprises a line break device mounted in said suction pressure portion of said shell, said electrical lead being routed through said second passage portion to said line break device without penetrating said shell.

10. The scroll gas compression apparatus according to claim 5 wherein said valve body defines a temperature sensor housing portion, said housing portion being an open volume in which said sensor is sealingly disposed, said sensor comprising a pressure boundary between said discharge pressure portion and said suction pressure portion of said passage.

11. The scroll gas compression apparatus according to claim 8 further comprising a valve cover, said valve cover defining a recess and cooperating in the definition of said first portion of said passage, said free floating valve moving into said recess defined by said valve cover so as to open said passage to flow when the pressure in said suction pressure portion of said shell exceeds the pressure in said first portion of said passage.

12. The valve assembly according to claim 11 further comprising means for guiding the movement of said vent valve in said recess.

13. A scroll gas compressor comprising:

a hermetic shell, said shell defining a suction pressure portion and a discharge pressure portion;

means for preventing the backflow of gas through said discharge pressure portion of said shell;

an orbiting scroll member disposed in said shell, said orbiting scroll member having an involute wrap;

a motor, said motor being drivingly connected to said orbiting scroll member;

a fixed scroll member disposed in said shell, said fixed scroll member having an involute wrap and defining a discharge aperture, said discharge aperture being in flow communication with said discharge pressure portion of said shell, the involute of said fixed scroll member being in interleaving engagement with the involute wrap of said orbiting scroll member so as to cooperatively define a plurality of pockets therebetween including a discharge pocket, said discharge pocket being in flow communication with said discharge aperture, said fixed scroll member further defining a passage opening into said suction pressure portion of said shell and into said discharge pressure portion of said shell at a location between said discharge pocket and said means for preventing backflow; and means, disposed in said passage, for preventing damage to said compressor, said means for preventing damage (i) opening said passage for flow when the pressure in said location between said discharge pocket and said means for preventive backflow is less than the pressure in said suction pressure portion of said shell and (ii) sensing the development of a temperature greater than a predetermined temperature in gas discharged from said discharge pocket and electrically signaling for the shut down of said motor when a temperature greater than said predetermined temperature is sensed.

14. The scroll gas compressor according to claim 13 wherein said means for preventing damage to said compressor comprises a valve assembly, said valve assembly dividing said passage into a first passage portion and a second passage portion, said first passage portion being in uninterruptable flow communication with said discharge pocket and said second passage portion being in uninterruptable flow communication with said suction pressure portion of said shell.

15. The scroll gas compressor according to claim 14 wherein said valve assembly includes a valve member, said valve member being biased by the pressure in said first passage portion of said shell to close said passage when the pressure in said first passage portion is greater than the pressure in said suction pressure portion of said shell.

16. The scroll gas compressor according to claim 14 wherein said valve assembly includes a temperature sensor, said temperature sensor being a pressure boundary between said first passage portion and said second passage portion, said temperature sensor being directly exposed to gas issuing from said discharge pocket.

17. The scroll gas compressor according to claim 16 further comprising means for interrupting electrical power to said motor, said temperature sensor being electrically connected to said means for interrupting power.

18. The scroll gas compressor according to claim 17 wherein said temperature sensor is connected to said means for interrupting power to said motor by an electrical lead, said lead being routed from said sensor to said means for interrupting power through at least a portion of said second passage portion.

19. The scroll gas compressor according to claim 18 wherein said vent valve is free floating and moves into said first passage portion in order to open said passage for flow, said valve assembly including means for guiding said vent valve in its movement.

20. A method for preventing damage to scroll gas compression apparatus upon the occurrence of abnormally high discharge temperatures or the reverse direction rotation of the scroll compression mechanism within the apparatus comprising the steps of:

dividing the shell of said apparatus into a suction pressure portion and a discharge pressure portion;

defining a passage between said suction pressure portion and said discharge pressure portion of said shell;

maintaining said passage closed to flow when the pressure of gas discharged from said compression mechanism exceeds the pressure in said suction pressure portion of said shell;

preventing the backflow of gas through said compression apparatus upon de-energization of said apparatus;

opening said passage to flow when the pressure in said suction pressure portion of said shell exceeds the pressure in the radially innermost pocket of the scroll compression mechanism;

sensing the temperature of gas discharged from said compression mechanism downstream of its issuance from the discharge port of the compression mechanism;

electrically signaling the sensing of a temperature in said discharge gas which is in excess of a predetermined temperature;

routing said electrical signal through said passage; and employing said signal to interrupt power to the compressor drive motor upon receipt of said electrical signal.

21. The method according to claim 20 comprising the further step of disposing a valve assembly in said passage, said valve assembly dividing said passage into a first passage portion and a second passage portion, said first passage portion being in uninterruptable flow communication with the discharge port of said compression mechanism and said second passage portion being in uninterruptable flow communication with said suction pressure portion of said shell.

22. The method according to claim 21 wherein said routing step includes the step of disposing an electrical lead in said second passage portion.

23. The method according to claim 22 wherein said step of opening said passage to flow includes the step of moving a valve into said first passage portion by the use of the pressure in said suction pressure portion of said shell.

24. The method according to claim 23 wherein said maintaining step includes the step of employing the pressure of gas discharge from said compression mechanism to pressure bias said valve member into a closed position.

25. The method according to claim 22 wherein said routing step includes the step of routing said lead out of said shell to an electrical contactor exterior of the shell of said compressor and wherein said employing step includes the step of opening said contactor upon receipt of said signal.

26. The method according to claim 22 wherein said routing step includes the step of routing said lead to a line break device internal of said shell.

* * * * *